US005472627A

United States Patent [19]

DeRosa et al.

[11] Patent Number: 5,472,627

[45] Date of Patent: Dec. 5, 1995

[54] POLYMERIC LUBRICANT ADDITIVE DESIGNED TO ENHANCE ANTI-WEAR, ANTI-OXIDANCY, AND DISPERSANCY THEREOF

[75] Inventors: Thomas F. DeRosa, Passaic, N.J.; Nicholas Benfaremo, Wappingers Falls, N.Y.; Maria M. Kapuscinski, Carmel, N.Y.; Benjamin J. Kaufman, Hopewell Junction, N.Y.; Rosemary J. Jennejahn, Nelsonville, N.Y.

[73] Assignee: Texaco Inc., White Plains, N.Y.

[21] Appl. No.: 346,360

[22] Filed: Nov. 29, 1994

Related U.S. Application Data

[63] Continuation of Ser. No. 576,808, Sep. 4, 1990, abandoned.

[51] Int. Cl.[6] ..... C10M 151/02

[52] U.S. Cl. ..... 252/47.5; 525/333.6; 525/349

[58] Field of Search ..... 252/47.5; 525/333.6, 525/349

[56] References Cited

U.S. PATENT DOCUMENTS 4,160,739 7/1979 Stambaugh et al. ..... 525/301
4,863,623 9/1989 Nalesnik ..... 252/50
5,013,469 5/1991 DeRosa et al. ..... 525/333.6

*Primary Examiner*—Ellen M. McAvoy

[57] ABSTRACT

A polymeric lubricant additive that behaves as a viscosity index improver and imparts enhanced anti-oxidancy, dispersancy, and anti-wear properties to said lubricant oil has been prepared. The polymeric substrate is a random co- or terpolymer of ethylene propylene and a third monomer; or a block terpolymer of styrene-(ethylenebutylene)-styrene where hydrogenation has removed aliphatic unsaturation. Ethylenically unsaturated carboxylic acid or acid anhydride is grafted to these aforementioned substrates and imidized with amino-thiadiazole of the formula:

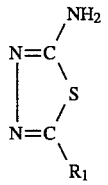

wherein $R_1$ is $H_2$ or a ($C_1$–$C_{10}$) alkyl radical selected from the group consisting of a alkyl, alkenyl, alkoxyl, aralkyl, alkaryl, hydroxyalkyl and aminoalkyl, to produce said polymeric lubricant additive.

9 Claims, No Drawings

POLYMERIC LUBRICANT ADDITIVE DESIGNED TO ENHANCE ANTI-WEAR, ANTI-OXIDANCY, AND DISPERSANCY THEREOF

This is a continuation of application Ser. No. 07/576,808 filed Sep. 4, 1990, now abandoned.

BACKGROUND OF THE INVENTION

This invention relates to a functionalized polymeric lubricant additive which behaves as a viscosity index improver (VII) when added to lubricating oil. In addition, dissolution of this polymeric additive in lubricating oil imparts oxidative protection, enhanced dispersancy, and anti-wear properties to said lubricant.

DISCLOSURE STATEMENT

U.S. Pat. No. 3,522,180 discloses a method for the preparation of an ethylene-propylene copolymer substrate effective as a viscosity index improver for lubricating oils.

U.S. Pat. No. 4,026,809 discloses graft copolymers of a methacrylate ester and an ethylene-propylene-alkylidene norbornene terpolymer as a viscosity index improver for lubricating oils.

U.S. Pat. No. 4,089,794 discloses ethylene copolymers derived form ethylene and one or more C3 to C28 alpha olefin solution grafted with an ethylenically-unsaturated carboxylic acid material followed by a reaction with a polyfunctional material reaction with said carboxylic acid groups, such as a polyamine, polyol, or a hydroxylamine which then produces a lubricant additive effective for sludge control.

U.S. Pat. No. 4,146,489 discloses a graft copolymer where the polymer backbone is an oil-soluble ethylene-propylene copolymer or an ethylene-propylene-diene modified terpolymer with a graft monomer of 2-or 4-vinylpyridine or N-vinylpyrrolidone to provide a dispersant VI improver for lubricating oils.

U.S. Pat. Nos. 4,259,540 and 4,798,853 disclose preparation of a styrene-ethylenebutylene-styrene block copolymer having a styrene rubber ratio of from about 0.2 to 0.5 which is useful as a waterproof filling material for electrical cables.

U.S. Pat. No. 4,320,019 discloses a multifunctional lubricating additive prepared by the reaction of an interpolymer of ethylene and a C3–C8 alpha-monoolefin with an olefinic carboxylic acid acylating agent to form an acylating reaction intermediate which is then reacted with an amine.

U.S. Pat. No. 4,340,689 discloses a process for grafting a functional organic group onto an ethylene-propylene copolymer or an ethylene-propylene-diene terpolymer.

U.S. Pat. No. 4,357,250 discloses a reaction product of a copolymer an olefin carboxylic acid via the "ene" reaction followed by a reaction with a mono-amine mixture U.S. Pat. No. 4,780,228 discloses the grafting of a hydrocarbon polymer in the absence of a solvent in the presence of a free radical initiator and a chain-stopped agent followed by a reaction with an amine, polyol or aminoalcohol.

U.S. Pat. No. 4,816,172 discloses the preparation of a polymeric lubricating oil additive that imparts both oxidative protection and enhanced dispersancy to lubricating oils.

U.S. Pat. No. 4,904,403 disclosed a method of preparing anti-wear oligomeric lubricating additives by containing a 1,3,4-thiadiazole nucleus.

Elastomerics 120 (10) 30-2 is a treatise on elastomers in general.

European Patent Application 0173380 discloses block copolymers exhibiting improved elastomeric properties.

The disclosures in the foregoing patents which relate to VI improvers and dispersants for lubricating oils, namely U.S. Pat. Nos. 3,522,180; 4,026,809; 4,089,794; 4,146,489; 4,259,540; 4,320,019; 4,340,689; 4,357,250; 4,780,689; 4,798,853; 4,816,172; and 4,904,403; Elastomerics 120 (10) 30-2; and European Patent Application 0173380 are incorporated herein by reference.

An objective of this invention is to provide a novel graft copolymer or block polymer composition that behaves as a viscosity index improver with enhanced anti-oxidancy, dispersancy, and anti-wear properties.

Another object of the invention is to provide a multifunctional lubricant additive effective for imparting anti-oxidancy, dispersancy and anti-wear properties to the lubricating oil composition.

A further object is to provide a novel lubricating oil composition containing the graft copolymer additive of the invention as well as to provide concentrates of the novel additive of the invention.

SUMMARY OF THE INVENTION

The reaction product of the invention comprises a chemical modification of an ethylene co- or terpolymer of a $C_3$–$C_{10}$ alpha-monoolefin containing a non-conjugated diene or triene termonomer, or a styrene-(ethylenebutylene)-styrene (S-EB-S) block polymer having an (S-EB-S) molecular weight ratio of 6:1 to 1:3:1, onto which an ethylenically unsaturated acid anhydride and/or carboxylic acid function is then further imidized with an aminothiazole (I) selected from the group consisting of

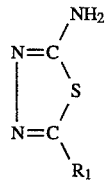

(I)

in which R1 is H2 or a ($C_1$–$C_{10}$) alkyl radical selected from the group consisting of alkyl, alkenyl, alkoxyl, aralkyl alkaryl, hydroxyalkyl and aminoalkyl.

The lubricant of the invention comprises an oil of lubricating viscosity and an effective amount of this novel reaction product. The lubricating oil will be characterized as behaving as a viscosity index improver with enhanced anti-wear, anti-oxidancy, and dispersancy properties.

Concentrates of the reaction product of the invention are also contemplated.

DETAILED DESCRIPTION OF THE INVENTION

The polymeric substrate employed in the novel additive of this invention may be a random polymer or a block terpolymer. If the polymeric substrate consists of blocks, the material may be prepared from styrene, ethylene and butylene to generate a styrene-(ethylenebutylene)-styrene (S-EB-S) block polymer having an S-EB-S molecular weight ratio of 1:6:1 to 1:3:1. Moreover, in the case of a random copolymer or terpolymer, the material may be prepared from ethylene or propylene or it may be prepared from ethylene and a higher olefin with the range of ($C_3$–$C_{10}$) alpha-olefins.

More complex non-block polymer substrates, often called interpolymers, may be prepared using a third component. The third component generally used to prepare an interpolymer substrate is a polyene monomer selected from non-conjugated dienes and trienes. The non-conjugated diene component is one having from 5 to 14 carbon atoms in the chain.

Preferably, the diene monomer is characterized by the presence of a vinyl group in its structure and can include monocyclic and bicyclo compounds. Representative dienes include 1,4-hexadiene,1,4-cyclohexadiene, dicyclopentadiene, 5-ethylidene-2-norbornene, 5-methylene-2-norborene, 1,5-heptadiene, and 1,6 octadiene. A mixture of more than one diene can be used in the preparation of the interpolymer. A preferred non-conjugated diene for preparing a terpolymer or interpolymer substrate is 1,4-hexadiene.

The triene component will have at least two nonconjugated double bonds, and up to about 30 carbon atoms in the chain. Typical trienes useful in preparing the interpolymer of the invention are 1-isopropylidene-3a,4,7,7a-tetrahydroindene, 1-isopropylidenedicyclopentadiene, dehydroisodicyclopentadiene, and 2-(2-methylene-4-methyl-3-pentenyl)-[2-2-1]bicyclo-5-heptene.

The polymerization reaction to form the polymer substrate is generally carried out in the presence of a catalyst in a solvent medium. The polymerization solvent may be any suitable inert organic solvent that is liquid under reactions conditions for solution polymerization of monoolefins conducted in the presence of a Ziegler-Natta type catalyst. Examples of satisfactory hydrocarbon solvents include straight chain paraffins having from 5–8 carbon atoms, with hexane being preferred; aromatic hydrocarbons having a single benzene nucleus, such as benzene, toluene and the like; and saturated cyclic hydrocarbons having boiling point ranges approximating those of the straight chain paraffinic hydrocarbons and aromatic hydrocarbons described above, are particularly suitable. Moreover, the solvent selected may be a mixture of one or more of the foregoing hydrocarbons. It is desirable that the solvent be free of substances that will interfere with the Ziegler-Natta polymerization process.

These block and random polymeric materials used are substantially linear hydrocarbons. The nature of the monomer addition for the random co- or terpolymer generates an essentially saturated polymer without any additional chemical manipulation. Polymeric materials consisting of blocks, however, require an additional processing step consisting of chemical hydrogenation to reduce the degree of unsaturation. More specifically, hydrogenation is performed in order to generate a styrene-ethylene-butylene-styrene block polymer having a styrene rubber ratio of approximately 0.2 to 0.5. The monoalkylenyl aromatic hydrocarbon (av. mol. wt. 2,000– 115,000) contained in the rubber comprises 5–95% of the polymer while the conjugated diene, viz., butadiene, is the second component of the rubber (av. mol. wt. 20,000–450,000). The material that is ultimately generated has a styrene rubber ratio of approximately 0.2 to 0.5. Upon selective hydrogenation using Raney Nickel or Group VIII metals, such as Pt or Pd, >50% of the initial unsaturation contained in the monoalkyleneyl aromatic hydrocarbon remains intact and <10% of the initial unsaturation contained in the butadiene remains. This has the advantage of permitting subsequent melt mixing of graftable monomer or monomers through an extruder and thermally initiating the free radical graft reaction with or without a free radical thermal initiator while minimizing crosslinking reactions in the polymer.

Block and random terpolymers were synthesized using anionic initiators, typically, but not restricted to, Zeigler-Natta catalysis. In those cases where Zeigler-Natta materials are used, transition metal salts are reacted with Group Ia, IIa, or IIIa metal halides under anhydrous and oxygen-free conditions in a variety of inert solvents. This method is very well known and described in the art. Other anionic catalysts are known including using Group Ia metals directly. This method is also well known and thereto described in the art.

Polymeric materials containing the aforementioned hydrogenated block segments of styrene-ethylene-butylene-estyrene are available commercially and are sold under the tradename 'Kraton'.

The preparation of random co- or terepolymers utilized in this process is described as follows. In a typical preparation of a polymer hexane is first introduced into a reactor and the temperature in the reactor is raised moderately to about 30° C. Dry propylene is fed to the reactor until the pressure reaches about 40–45 inches of mercury. The pressure is then increased to about 60 inches of Hg and dry ethylene and 5-ethylidene-2-norbornene are fed to the reactor.

The monomer feeds are stopped and a mixture of aluminum sesquichloride and vanadium oxytrichloride are added to initiate the polymerization reaction. Completion of the polymerization reaction is evidenced by a drop in the pressure in the reactor.

Ethylene-propylene or higher alpha monoolefin copolymers may consist of from about 15 to 80 mole percent ethylene and from about 20 to 85 mole percent propylene or higher monoolefin with the preferred mole ratios being from about 45 to 80 mole percent ethylene and from about 20 to 55 mole percent of a ($C_3$–$C_{10}$) alpha monoolefin. Terpolymer variations of the foregoing polymers may contain from about 0.1 to 10 mole percent of a non-conjugated diene or triene. The polymer substrate, that is the ethylene copolymer or terpolymer is an oil-soluble, substantially linear, rubbery material having a number average molecular weight from about 5,000 to 500,000 with a preferred number average molecular weight range of 25,000 to 250,000 and a most preferred range from about 50,000 to 150,000.

The terms polymer and copolymer are used generically to encompass ethylene copolymers, terpolymers or interpolymers. These materials may contain minor amounts of other olefinic monomers so long as their basic characteristics are not materially changed. Polymer substrates or interpolymers are available commercially. Particularly useful are those containing from about 40 to 60 mole percent ethylene units and about 40 to 60 mole percent propylene units.

Examples of such polymers are "Ortholeum 2052" and "PL-1256" which are manufactured and sold by E. I. Dupont deNemours and Company of Wilmington, Del. The former polymer is a terpolymer containing 48 mole percent ethylene units, 48 mole percent propylene units, and 4 mole percent 1,4-hexadiene units and having an overall inherent viscosity of 1.35. The latter is a similar polymer with an inherent viscosity of 1.95. The viscosity average molecular weights are these two materials are on the order of 200,00 and 280,000 amu, respectively.

Modification of these polymeric substrates is desirable since it generates reactive sites on these materials that are amenable to post-reactioning with strategically important monomers. Ethylenically unsaturated materials containing pendant acid anhydride and carboxylic acid groups are grafted onto the polymer backbone. These materials contain at least one ethylenic bond and at least one, preferably two, carboxylic acid or anhydride groups or a polar group which is convertible into a carboxyl group by oxidation or hydrolysis. Maleic anhydride or a derivative thereof is preferred. It grafts onto block or random polymers to give two carboxylic acid functions or a single acid anhydride functionality. Examples of additional unsaturated carboxylic materials that are amenable to this grafting include chloromaleic anhydride, itaconic anhydride, or the corresponding dicarboxylic acid such as maleic acid, fumaric acid and their monoesters.

The ethylenically unsaturated carboxylic acid material may be grafted to these aforementioned block or random polymers in a number of ways. The modification may be performed by a process known as the "ene" reaction or by solution grafting using a free radical initiator. If the grafting utilizes a solvent, an inert hydrocarbon is preferred since it is inert and unreactive. Free radical initiators amenable to this process include peroxides, hydroperoxides, and azo compounds, especially those which have a boiling point greater than 100° C. and thermally decompose within the grafting temperature range to ensure an adequate supply of free radicals. Representative of these free radical initiators include, but are not limited to, azobutronitrile and 2,5-dimethyl-hex-3-yne-2,5-bis-t-butyl peroxide. The initiator is used in an amount between 0.005% to 2.0% by weight based on the weight of the reaction mixture. Typically the grafting reaction is performed at an elevated temperature in the range of about 100° C. to 250° C., preferably 120° C. to 190° C., and more preferably at 150° C. to 180° C., ie., above 160° C. Ideally, the grafting solvent is similar or identical to that used in the polymerization reaction and typically contains 40 wt % polymer based on the initial total oil solution. Furthermore, to circumvent oxidative degradation of the polymeric substrate, grafting reactions are performed under an inert atmosphere.

And, finally, if any component of the grafting procedure including solvent is especially volatile, the reaction may be performed in a enclosed vessel under moderate to high pressure using the aforementioned conditions and material requirements. In contrast, however, when the "ene" reaction is utilized as the grafting protocol, the reaction is typically performed without the use of a free radical initiator. Moreover, the reaction may be performed in the absence of any solvent and at elevated pressures to trap volatile components.

Finally, a grafting strategy best characterized as a hybrid of free radical solution grafting and thermal or "ene" reaction grafting is extruder or mastication grafting. In this design the unsaturated monomer or monomers are physically mixed with the polymer, with or without a charge of free radical initiator, and the mixture passed through a single or twin screw extruder at temperatures typically in the range of 150° C. to 400° C. If a free radical initiator is used, it is to ensure an adequate supply of free radicals; however, in its absence more than one extruder pass may be performed to ensure high grafting levels.

Polymeric materials containing hydrogenated blocks of styrene-ethylene-butylene-styrene with grafted succinic anhydride are available commercially and are sold under the tradename of "Kraton(R)" by Shell Chemical Company of Houston, Tex. Polymeric materials containing randomly incorporated ethylene-propylene alone or in conjunction with a third monomer may be ethylene-propylene-succinic-anhydride (EPSA), but are not available commercially.

The block or random polymer or interpolymer intermediate possessing acid anhydride or carboxylic acid acylating functions is reacted with an amino-heterocyclic compound consisting of:

a) an amino-thiadiazole represented by the formula:

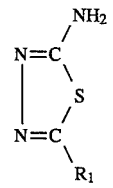

where $R_1$ is $H_2$ or a ($C_1$–$C_{10}$) alkyl radical selected from the group consisting of alkyl, alkenyl, alkoxyl, aralkyl alkaryl, hydroxyalkyl and aminoalkyl.

The process for preparing these multifunctional viscosity index improvers involves charging diluent oil and solid grafted rubber, viz., Kraton(R) or EPSA, to the reaction flask and dissolving the rubber in oil at 195° C. under a blanket of nitrogen. The amino-thiadiazole compound is then charged as a neat granular solid or as a 10–20% solution in an oil soluble solvent, such as commercial alkyl or alkylaryl polyethylene or polypropylene glycol. The imidization step of reacting the amino-thiadiazole with the polymer bound succinic anhydride is carried out over several hours at the aforementioned temperature and under a protective nitrogen atmosphere. On completion of the imidization step, the material is cooled to 100° C. and screen filtered through a 200 mesh filter and the product isolated. These VI improvers obtained as imidization products of either EPSA or Kraton(R) are polymeric oil additives that impart viscosity index improvement to natural or synthetic oils in addition to thermal stability, enhanced dispersancy, and anti-wear properties.

The following Examples illustrate the preparation and testing of these experimental materials, as well as the advantages of their use.

EXAMPLE I 60 grams of maleic anhydride graft ethylene-propylene copolymer rubber consisting of about 58 mole percent ethylene and 42 mole percent propylene and containing a number average molecular weight of 80,000 on which has been grafted 1 weight percent maleic anhydride was dissolved in 485 grams solvent neutral oil at 160° C. while the mixture was maintained under a nitrogen blanket along with mechanical stirring. After the polymer had dissolved, the reaction kettle temperature is raised to 195° C. and 0.6 gram of 2-amino-thiadiazole added neat and stirring and heating continued for two hours. The imidized graft copolymer was filtered through a 200 mesh filter and the polymer additive is isolated and recovered.

EXAMPLE II

The same procedure of Example I is used in this Example, except 2-amino-thiadiazole dissolved in a polyether surfactant (Surfonic L-85) is substituted for the 2-aminothiadiazole in the aforementioned Example I. The same polymer additive is isolated and recovered.

EXAMPLE III

The same procedure of Example I is used in this Example, except 2-amino-thiadiazole dissolved in a polyether surfactant (Surfonic N-100) is substituted for the 2-aminothiadiazole in the aforementioned Example 1. The same polymer additive is isolated and recovered.

EXAMPLE IV

The same procedure of Example I is used in this Example, except Kraton(R) is substituted for the 2-aminothiadiazole in Example I. The same polymer additive is isolated and recovered.

EXAMPLE V

The same procedure of Example I is used in this Example, except 2-amino-thiadiazole dissolved in Surfonic L-85 is substituted for the 2-amino-thiadiazole in the aforementioned Example I. The same polymer additive is isolated and recovered.

EXAMPLE VI

The same procedure of Example I is used in this Example, except 2-amino-thiadiazole dissolved in a polyether surfactant (Surfonic N-100) is substituted for the 2-aminothiadiazole in the aforementioned Example I. The same polymer additive is isolated and recovered.

The novel graft and derivatized polymer of the invention is useful as a polymeric additive for lubricating oils. They are multifunctional additives for lubricants being effective as viscosity index improver that impart enhanced anti-wear, antioxidancy, and dispersancy properties to natural and synthetic lubricating oils and mixtures thereof. This novel polymeric additive can be employed in crankcase lubricating oils for spark-ignited and compression-ignited internal combustion engines. The compositions can also be used in gas engines, or turbines, automatic transmission fluids, gear lubricants, metal-working lubricants hydraulic fluids, and other lubricating oil and grease compositions. And, their use in motor fuel compositions is also contemplated.

The base oil may be a natural oil including liquid petroleum oils and solvent-treated or acid-treated mineral lubricating oils of the paraffinic, naphthenic and mixed paraffinic-naphthenic types.

In general, the lubricating oil composition of the invention will contain the novel reaction product in a concentration ranging from about 0.1 to 30 weight percent. A preferred concentration range for the additive is from about 1 to 15 weight percent based on the total weight of the oil composition.

Oil concentrates of the additive may contain from about 1 to 50 weight percent of the additive reaction product in a carrier or diluent oil of lubricating oil viscosity.

The novel reaction product of the reaction may be employed in lubricating oil compositions together with conventional lubricant additives. Such additives may include additional dispersants, detergents, anti-oxidants, pour point depressants, anti-wear agents and the like.

The dispersant propertities of the additive-containing oil are determined in the Bench Sludge VE Test. Dispersancy of a lubricating oil is determined relative to three references which are the results from three standards blends tested with the unknown. The test additives were blended into a formulated oil containing no dispersant. The additive reaction product was employed in the oil at a concentration of 12.0 weight percent polymer solution.

The product prepared in these examples were blended into formulated not containing dispersant to form 1.20 weight percent polymer solutions. These blends were tested for dispersancy in the above test, results of which are summarized below in Table I. In this test dispersancy is compared to that of three reference oils which are tested along with the experimental samples. Dispersant effectiveness is characterized as pass (P), marginal pass (MP), or fail (F).

TABLE I

BENCH SLUDGE TEST

| Additive | Result |
|---|---|
| OCP Rubber (Poly(ethylene-co-propylene) | Fail |
| EPSA [Poly(ethylene-co-propylene)-g-maleic anhydride] | Fail |
| Kraton(R) [Poly(styrene-b-ethylene-b-butylene-b-styrene)-g-maleic anhydride)] | Fail |
| Example 1 | Pass |
| Example 2 | Pass |
| Example 3 | Pass |
| Example 4 | Pass |
| Example 5 | Pass |
| Example 6 | Marginal Pass |
| Commercial DOCP | Pass |

The results from this test show that the subject of this invention gave consistently better dispersancy performance then the corresponding unmodified OCP rubber or non-imidized EPSA or Kraton(R).

The antioxidant properties of the novel reaction product in a lubricating oil was determined in the bench oxidation test. In this test, 1.5 weight percent of the additive reaction product is blended into the solvent neutral oil (S.U.S. at 100° F. of 130°). The mixture is continuously stirred while being heated and accompanied by bubbling with air. Samples are periodically withdrawn for analysis by Differential Infrared Absorption (DIR) to observe changes in the intensity of the carbonyl vibration band at 1710 cm-1. A low carbonyl vibration band intensity indicates higher thermal-oxidative stability of the sample. Below, Table II summarizes the results of the BOT testing.

TABLE II

BENCH OXIDATION TEST

| Additive | Result |
|---|---|
| OCP Rubber [Poly(ethylene-co-propylene] | >20 |
| EPSA [Poly(ethylene-co-propylene)-g-maleic anhydride] | >20 |
| Kraton(R) [Poly(styrene-b-ethylene-b-butylene-b-styrene)-g-maleic anhydride] | >20 |
| Example 1 | 4.1 |
| Example 4 | 2.3 |
| Commercial NVP grafted DOCP | 15 |

The test data in Table II demonstrate that substantial anti-oxidative properties result when imidization EPSA or Kraton(R) have been imidized using amino-thiadiazole.

The novel reaction product of this invention is tested for its effectiveness as an anti-wear additive in formulated lubricating compositions.

The lubricating oil composition used in this testing is illustrated below in Table III.

TABLE III

| Component | Parts By Wgt |
|---|---|
| Solvent Neutral Oil A | 83.50 |
| Solvent Neutral Oil B | 5.00 |
| Product | 11.50 |

Anti-wear properties of the novel additive were evaluated using the Four Ball Wear Test, ASTM Test No. MS 82-79. In this test the oil is heated to 167° F. for 60 minutes at 600 RPM's under a 40 kg load. Anti-wear properties are assessed on the basis of scar diameters of standardized components. Reference oil samples containing unmodified EPSA, and Kraton (R) ethylene-propylene copolymers ethylene-propylene terpolymers, are first evaluated so that a comparison with the chemically modified polymer becomes possible.

To assess wear resistance of ethylene-propylene copolymers containing grafted amino-thiadiazole, this experimental material was subjected to the Four Ball Wear Test. An 11.5 weight percent of imidized EPSA or Kraton (R) was subjected to a 40 kg weight at 600 RPM's at 167° F. for 60 minutes. Results of Four Ball Wear Testing are provided below in Table IV.

TABLE IV

FOUR BALL WEAR TEST

| Material | Average Scar Diameter (mm) |
|---|---|
| OCP Rubber [Poly(ethylene-co-propylene] | 0.77 |
| EPSA [Poly(ethylene-co-propylene)-g-maleic anhydride] | 0.91 |
| Kraton(R) [Poly(styrene-b-ethylene-butylene-styrene)-g maleic anhydride] | 0.94 |
| Example 1 | 0.46 |
| Example 4 | 0.40 |

It is immediately evident that by chemically incorporating imidizing EPSA or Kraton(R) with aminothiadiazole, wear resistance is dramatically enhanced.

What is claimed is:

1. An anti-wear, anti-oxidancy dispersant polymeric lubricant additive composition prepared by the steps comprising:

(a) reacting a polymer prepared from ethylene and at least one ($C_2$–$C_{10}$) alpha-monoolefin and, optionally, a polyene selected from non-conjugated dienes and trienes comprising from about 15 to 80 mole percent of said ethylene, from about 20 to 85 mole percent of said ($C_3$–$C_{10}$) alpha-monoolefin and from about 0 to 15 mole percent of said polyene, and having a number average molecular weight ranging from about 5,000 to 500,000, with at least one olefinic carboxylic acid or acid anhydride acylating agent to form one or more acylating reaction intermediates having a carboxylic acid or acid anhydride acylating function within their structure; and (b) reacting said reaction intermediate with an amino thiadiazole containing an amine represented by the formula:

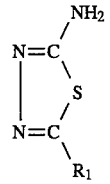

wherein $R_1$ is $H_2$ or a ($C_1$–$C_{10}$) alkyl radical selected from the group consisting of alkyl, alkenyl, alkoxyl, aralkyl alkaryl, hydroxyalkyl and aminoalkyl, to produce said polymeric lubricant additive.

2. A composition according to claim 1 in which said polymer has an average molecular weight ranging from about 5,000 to about 250,000.

3. A composition according to claim 1 in which said polymer has an average molecular weight ranging from about 50,000 to about 150,000.

4. A composition according to claim 1 in which said acid anhydride agent is maleic anhydride.

5. A composition according to claim 1 in which said acid anhydride agent is itaconic anhydride.

6. A composition according to claim 1 in which said aminothiadiazole is 2-amino-l,3,4-thiadiazole.

7. A lubricating oil composition comprising a major amount of an oil of lubricating viscosity and a minor amount, effective to impart viscosity index dispersancy, anti-oxidant, dispersancy, and anti-wear properties to said oil, of a polymeric lubricant additive composition prepared by the steps comprising:

a) reacting a polymer prepared from ethylene and at least one ($C_3$–$C_{10}$) alpha-monoolefin and, optionally, a polyene selected from non-conjugated dienes and trienes, comprising from about 15 to 80 mole percent of said ethylene, from about 20 to 85 mole percent of said ($C_3$–$C_{10}$) alpha-monoolefin and from about 0 to 15 mole percent of said polyene, and having an average molecular weight ranging from about 5,000 to 500,000, with at least one olefinic carboxylic acid or acid anhydride acylating agent to form one or more acylating reaction intermediates having a carboxylic acid or acid anhydride acylating function within their structure; and (b) reacting said reaction intermediate in with an aminothiadiazole represented by the formula:

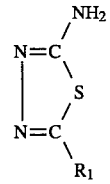

wherein $R_1$ is $H_2$ or a ($C_1$–$C_{10}$) alkyl radical selected from the group consisting of alkyl, alkenyl, alkoxyl, aralkyl alkaryl, hydroxyalkyl or aminoalkyl, to produce said polymeric lubricant additive.

8. A lubricating oil composition according to claim 7 in which said amino-thiadiazole is 2-amino-l,3,4-thiadiazole.

9. A concentrate for a lubricating oil comprising a diluent oil of lubricant viscosity and from about 1 to 50 weight percent of the additive composition of claim 1 based on the total weight of the concentrate.

* * * * *